US005820101A

United States Patent [19]

Ricco

[11] Patent Number: 5,820,101

[45] Date of Patent: Oct. 13, 1998

[54] ELECTROMAGNETIC METERING VALVE FOR A FUEL INJECTOR

[75] Inventor: Mario Ricco, Bari, Italy

[73] Assignee: Elasis Sistema Ricerca Fiat Nel Mezzogiorno Societa Consortile Per Azioni, Pomigliano, Italy

[21] Appl. No.: 987,824

[22] Filed: Dec. 9, 1997

[30] Foreign Application Priority Data

Dec. 23, 1996 [IT] Italy ..... TO96 A 001074

[51] Int. Cl.[6] ..... F16K 31/02

[52] U.S. Cl. ..... 251/129.16; 251/129.19; 251/129.21; 239/533.8; 239/585.1

[58] Field of Search ..... 251/129.16, 129.19, 251/129.14, 129.21; 239/533.8, 585.1

[56] References Cited

U.S. PATENT DOCUMENTS

| | | | |
|---|---|---|---|
| 3,473,780 | 10/1969 | Harms | 251/129.19 |
| 3,970,282 | 7/1976 | Hansen | 251/129.19 |
| 5,114,077 | 5/1992 | Cerny | 251/129.16 |
| 5,154,350 | 10/1992 | Ausiello et al. | 239/533.8 |
| 5,238,224 | 8/1993 | Horsting | 251/129.16 |
| 5,395,048 | 3/1995 | Ricco et al. | 239/533.8 |
| 5,560,549 | 10/1996 | Ricco et al. | 251/129.21 |

*Primary Examiner*—Denise L. Ferensic
*Assistant Examiner*—John Ball
*Attorney, Agent, or Firm*—Ladas & Parry

[57] ABSTRACT

The metering valve has a shutter for a discharge conduit, and an electromagnet for controlling an armature disconnected from a respective stem and sliding along the stem by means of a respective sleeve; the stem is guided by a bush and pushed by a first spring to keep the shutter in the closed position; and the armature is held axially resting against the stem by a second spring preloaded between the armature and an annular shoulder of the stem, so as not to affect the action of the first spring.

12 Claims, 3 Drawing Sheets

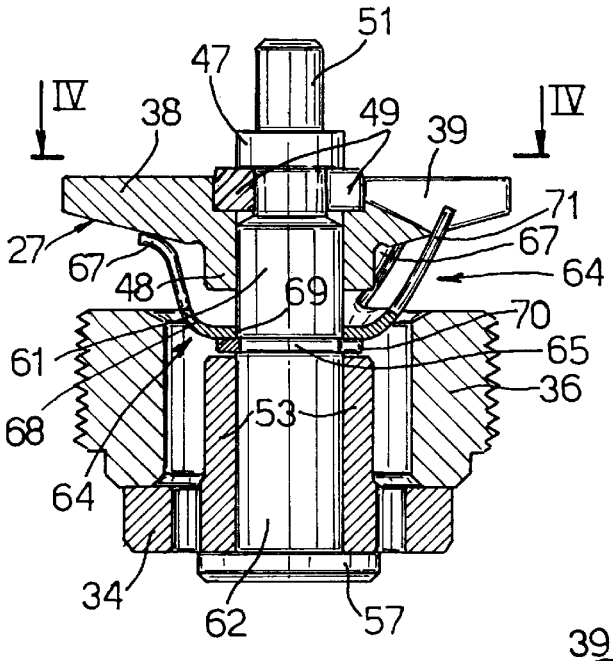
Fig.3
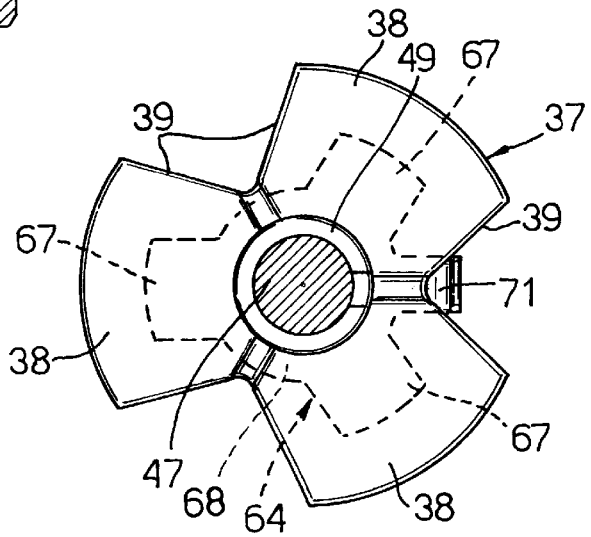
Fig.4
Fig.5
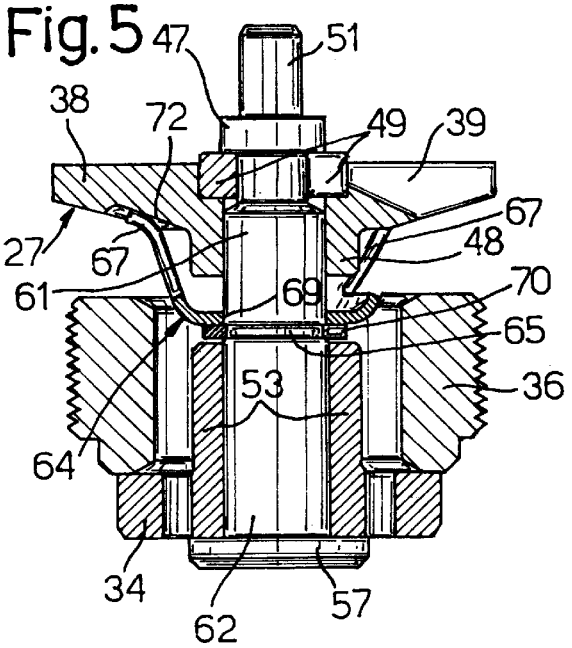
Fig.6
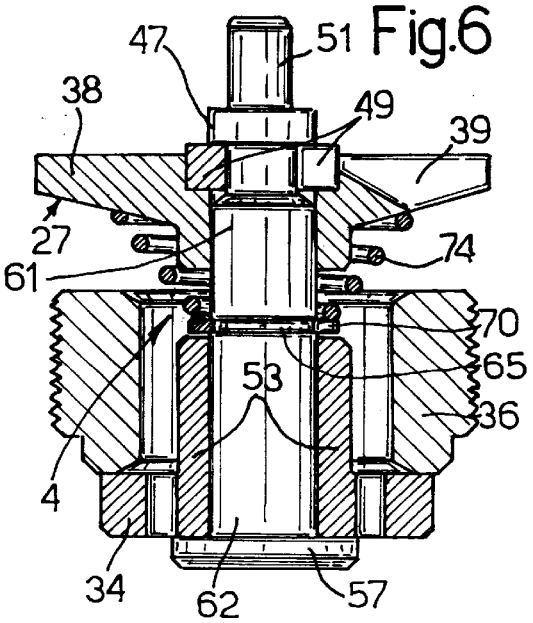

ELECTROMAGNETIC METERING VALVE FOR A FUEL INJECTOR

BACKGROUND OF THE INVENTION

The present invention relates to a perfected electromagnetic metering valve for a fuel injector, in particular for internal combustion engines.

The metering valves of fuel injectors normally comprise a control chamber with a discharge conduit, which is normally closed by a shutter by means of a preloaded main spring of force F1, and which is opened by energizing an electromagnet to so move the armature as to overcome the force exerted by the spring. In known valves, the armature is normally rigidly connected to a stem sliding inside a fixed guide.

When closing the discharge conduit, the kinetic energy of the armature and the stem is dissipate in the impact of the shutter against the valve; and, when opening the discharge conduit, the kinetic energy of the return stroke of the armature and the stem is dissipated in the impact of the stem against a stop.

Such impact generates considerable force proportional to the mass and speed of the armature and stem and inversely proportional to the duration of impact, which is very short; and, on account of the hardness of the stem, ball and body of the valve, results in considerable rebound, both when opening and closing the valve, so that the movement of the armature fails to provide for steady operation of the injector.

One proposal to reduce rebound of the mass arrested in both the opening and closing stroke is to disconnect the armature from the stem, and provide an additional preloaded spring of force F2 between the armature and a fixed shoulder. The force F1 of the main spring, which holds the shutter in the closed position, acts on the stem in opposition to, and is greater than, force F2 of the additional spring. In yet another known valve, the stem is provided with a flange housed inside a chamber in which fuel is circulated, and in which the movement of the flange creates a certain amount of turbulence to further reduce rebound.

Such known valves, however, present the drawback of not allowing a small interval between two consecutive movements of the armature, as requested, for example, by high-speed injection engines. In particular, such valves are unsuitable for engines requiring a preinjection of fuel shortly before the main injection. In which case, in fact, force F2 of the additional spring would have to be increased to enable rapid return of the armature to the rest position after each operation, and so ensure rapid correct repeat operation of the armature.

As the force F required to close the shutter, however, equals F1−F2, increasing force F2 of the additional spring would necessarily mean a corresponding increase in force F1 of the main spring, which is difficult to do on account of the invariably small space available for the main spring. Particularly in the case of a main spring comprising a helical spring housed inside the magnetic core of the electromagnet, any increase in the space allotted for the main spring would necessarily involve altering the magnetic circuit, fabricating the magnetic core using other than sintered materials, and difficulty in assembling a highly preloaded spring.

SUMMARY OF THE INVENTION

It is an object of the present invention to provide a straightforward, reliable metering valve of the above type, designed to overcome the aforementioned drawbacks typically associated with known valves, and which provides for ensuring rapid return of the armature and shutter control stem to the idle position.

According to the present invention, there is provided a metering valve comprising a shutter for a discharge conduit of a control chamber; a first spring acting against an intermediate element to keep said shutter in the closed position; and an electromagnet for activating an armature to control said shutter via said intermediate element; said armature being disconnected from said intermediate element, and being held resting against said intermediate element by a second spring; characterized in that said second spring is preloaded between said armature and said intermediate element, so as not to affect the action of said first spring.

BRIEF DESCRIPTION OF THE DRAWINGS

Two preferred, non-limiting embodiments of the present invention will be described by way of example with reference to the accompanying drawings, in which:

FIG. 3 shows a partial half section of the metering valve of the injector according to a further variation of the invention;

FIG. 4 shows a partial section along line IV—IV in FIG. 3;

FIGS. 5 and 6 show two partial half sections of the metering valve of the injector according to a further two variations of the invention.

DETAILED DESCRIPTION OF THE INVENTION

Figure 1:
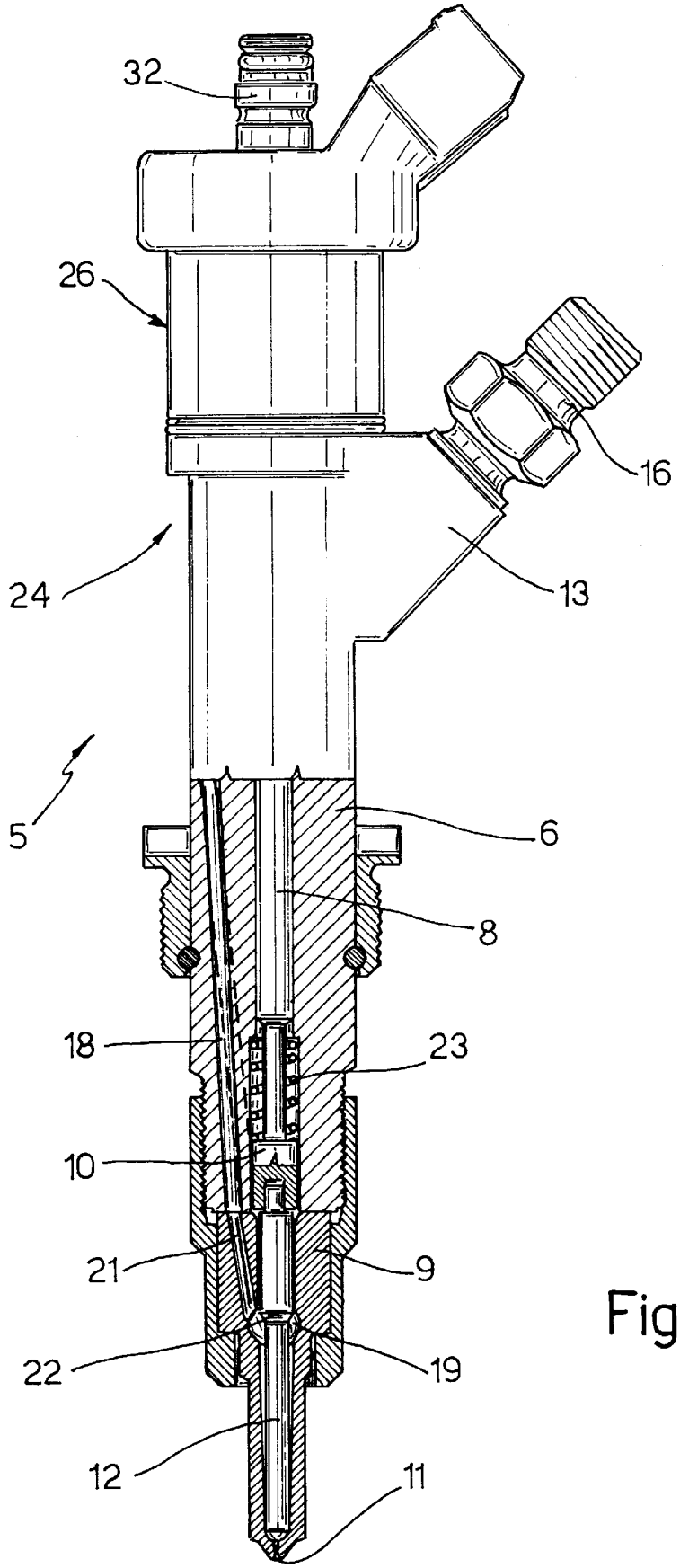
FIG. 1 shows a partially sectioned side view of a fuel injector featuring a metering valve in accordance with the present invention.

Number 5 in FIG. 1 indicates a fuel injector, e.g. for a diesel internal combustion engine, comprising a hollow body 6 connected to a nozzle 9 terminating with or more injection orifices 11; and a control rod 8 slides inside body 6, and is connected by a plate 10 to a pin 12 for closing orifice 11.

Body 6 comprises an appendix 13 in which is inserted an inlet fitting 16 connected to a normal fuel supply pump, and which in turn comprises a hole 14 (FIG. 2) communicating via conduits 17, 18 and 21 with an injection chamber 19 of nozzle 9; pin 12 comprises a shoulder 22 on which the pressurized fuel in chamber 19 acts; and a compression spring 23 assists in pushing pin 12 downwards.

Injector 5 also comprises a metering valve indicated as a whole by 24, and in turn comprising an electromagnet 26 for controlling an armature 27; electromagnet 26 comprises an annular magnetic core 28 housing a normal electric coil 29; and core 28 comprises a central hole 31 coaxial with a discharge fitting 32 fitted to a body integral with core 28, and connected to the fuel tank.

Metering valve 24 also comprises a body 33 having a flange 34 normally held resting against a shoulder of body 6 by an externally-threaded ring nut 36, which is screwed to a thread of a discharge chamber 37 formed in body 6; and armature 27 is substantially disk-shaped, and has a number of, e.g. three, sectors 38 (FIG. 4) separated by slots 39 through which discharge chamber 37 communicates with central hole 31 of core 28.

Body 33 of valve 24 also comprises an axial control amber 41 in turn comprising an inlet conduit 42 communicating with hole 14, and a discharge conduit 43 communicating with discharge chamber 37. Control chamber 41 is defined at the bottom by the top surface of rod 8; and, by virtue of the larger area of the top surface of rod 8 as compared with that of shoulder 22 (FIG. 1), the pressure of the fuel, with the aid of spring 23, normally keeps rod 8 in such a position as to close orifice 11 of nozzle 9.

Discharge conduit 43 of control chamber 41 is normally closed by a shutter in the form of a ball 44, which rests on a conical seat defined by the contact surface with conduit 43; ball 44 is guided by a guide plate 46 on which acts an intermediate element comprising a cylindrical stem 47; and armature 27 forms one piece with a sleeve 48 sliding axially along stem 47, which comprises a C-shaped ring 49 cooperating with a shoulder 50 of armature 27, so that armature 27 is disconnected from stem 47.

A given length of stem 47 projects inside hole 31 and terminates with a small-diameter portion 51 for supporting and anchoring a first compression spring 52 housed inside hole 31; stem 47 slides inside a guide comprising a cylindrical bush 53 forming one piece with a bottom flange 54 comprising axial holes 56; and, at the bottom, stem 47 comprises an integral flange 57, which is arrested against the bottom surface of flange 54.

Flange 54 is forced by ring nut 36 against flange 34 of body 33 of valve 24 via the interposition of calibrated washers for defining the desired travel "h" of stem 47; and spring 52 is preloaded to a force F1 to enable stem 47 to move armature 27 rapidly downwards when electromagnet 26 is de-energized, and, by means of plate 46, to keep ball 44 in the closed position over conduit 43.

Flange 57 of stem 47 is housed inside a swirl chamber 58 in which the fuel discharged from control chamber 41 is compressed and expanded by the movement of flange 57; and bush 53 forms with ring nut 36 a gap 59 enabling the fuel in chamber 58 to flow through holes 56 into discharge chamber 37.

According to the invention, stem 47 comprises a portion 61 on which sleeve 48 of armature 27 slides, and a portion 62 sliding inside bush 53 and larger in diameter than portion 61; and an annular shoulder 63 is defined between portions 61 and 62 to support a second spring 64, which acts on armature 27 so that shoulder 50 is normally held resting against ring 49 of stem 47.

Figure 2:
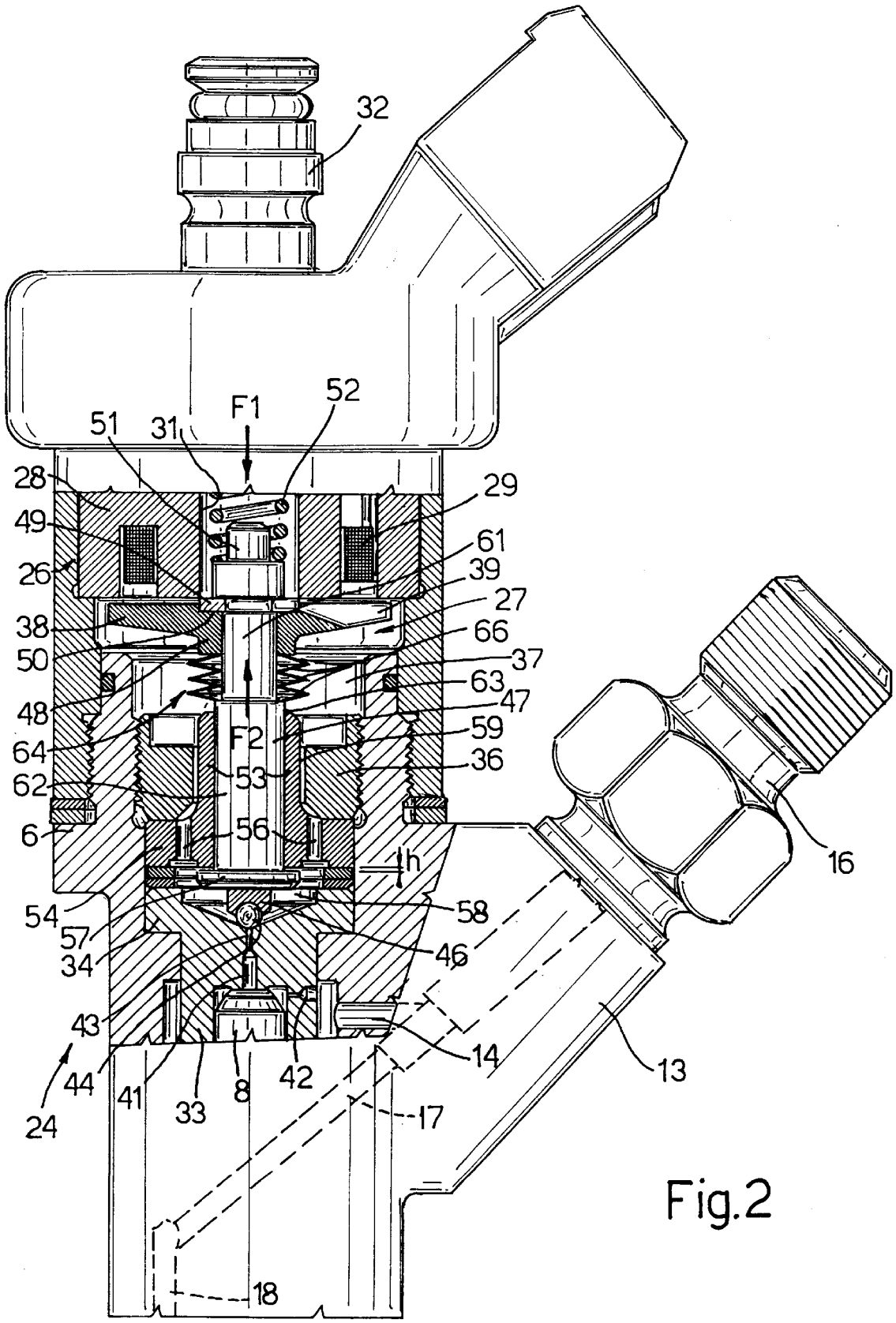
FIG. 2 shows a larger-scale half section of the metering valve of the FIG. 1 injector according to a first variation of the invention.

More specifically, spring 64 may be a multiple-leaf spring, which, according to the FIG. 2 variation, comprises a pack of pairs of coaxial Belleville washers 66; the top washer 66 rests against armature 27, and the bottom washer 66 against shoulder 63; and spring 64, preloaded to a force F2, is fitted between the disk of armature 27 and annular shoulder 63.

Being released on stem 47 itself, spring 64 may be increased by any amount to reduce the return to rest time of armature 27, and so reduce the time interval between two consecutive operations of metering valve 24 by electromagnet 26. Spring 64, in fact, no longer affects sealing of ball 44, which is ensured solely by spring 52, which, by not having to overcome the force of counteracting spring 64, provides for more effectively moving ball 44 into the closed position. Alternatively, for a given action on ball 44, the preload or size of spring 52 may be reduced.

The injector described operates as follows.

When coil 29 is energized, core 28 attracts armature 27, which, by means of shoulder 50 and C-shaped ring 49, positively draws stem 47 upwards in opposition to spring 52; flange 57 of stem 47 produces turbulence inside chamber 58, i.e. the fuel in chamber 58 is compressed on the one hand and expanded on the other, to cushion the arrest of flange 57 of stem 47 against fixed flange 54; and armature 27 is braked by the fuel inside discharge chamber 37 and arrested with shoulder 50 against ring 49. The disconnection of armature 27 and stem 47 therefore provides for absorbing the kinetic energy of the two components separately.

The fuel pressure inside chamber 41 therefore moves ball 44 into the open position to discharge the fuel from chamber 41 back into the tank; and the fuel pressure inside chamber 19 (FIG. 1) overcomes the residual pressure on the upper surface of rod 8 to raise pin 12 and so inject the fuel in chamber 19 through orifice 11.

When coil 29 is de-energized, spring 52 pushes stem 47 down so as to draw armature 27 down by means of ring 49; the kinetic energy of stem 47 is also partly dissipated by the turbulence created by flange 57 in the fuel inside chamber 58, so as to effectively cushion the impact and substantially eliminate rebound of stem 47, plate 46 and ball 44; ball 44 closes discharge conduit 43; and the pressurized fuel restores the pressure inside control chamber 41, so that pin 12 (FIG. 1) closes orifice 11.

In the FIG. 3–6 variations, portions 61 and 62 of stem 47 have the same diameter—and are therefore cheaper to produce—and are separated by a groove 65 in which is fitted a further C-shaped ring 70 acting as a shoulder. In the FIG. 3, 4 and 5 variations, multiple-leaf spring 64 comprises a number of elastic tabs 67 forming one piece with a concave disk 68 having a central hole 69 and resting on ring 70; and tabs 67 are equal in number to, and rest against, sectors 38.

To prevent armature 27 and spring 64 from rotating with respect to each other, in the FIG. 3 and 4 variation, disk 68 comprises an appendix 71 located between two tabs 67 and engaging a slot 39 between two adjacent sectors 38; and, in the FIG. 5 variation, one of sectors 38 of armature 27 comprises a cavity 72 engaged by one of elastic tabs 67 of spring 64.

Finally, in the FIG. 6 variation, a truncated-cone-shaped helical compression spring 74 is preloaded between armature 27 and C-shaped ring 70, with the larger-diameter turn contacting armature 27, and the smaller-diameter turn contacting ring 70.

As compared with known valves, the advantages of metering valve 24 according to the invention will be clear from the foregoing description. In particular, the return speed of armature 27 may be increased without having to increase the preload of counteracting spring 52. As such, the force of electromagnet 26 or the size of magnetic core 28 need not be increased; special materials of greater mechanical strength or high-cost fabrication processes need not be employed; and, finally, the preload or size of spring 64 may be reduced to simplify assembly.

Clearly, changes may be made to the metering valve as described and illustrated herein without, however, departing from the scope of the present invention. For example, spring 64, 74 may be of a type other than that described. In particular, in the FIG. 3 and 4 variation, spring 64 may comprise two or more appendixes 71; in the FIG. 5 variation, sectors 38 of armature 27 may each comprise a cavity 72; and, in the FIG. 6 variation, helical compression spring 74 may be cylindrical as opposed to truncated-cone-shaped.

I claim:

1. An electromagnetic metering valve for a fuel injector, comprising a shutter (44) for a discharge conduit (43) of a control chamber (41); a first spring (52) acting against an intermediate element (47) to keep said shutter (44) in a closed position; and an electromagnet (26) for activating an armature (27) to control said shutter (44) via said intermediate element (47); said armature (27) being disconnected from said intermediate element (47), and being held resting against said intermediate element (47) by a second spring (64, 74); characterized in that said second spring (64, 74) is preloaded between said armature (27) and said intermediate element (47), so as not to affect the action of said first spring (52).

2. A valve as claimed in claim 1, wherein said armature is substantially in the form of a disk (27) forming one piece with a sleeve (48), and said intermediate element is in the form of a stem (47) coaxial with said disk (27); said sleeve (48) sliding on said stem (47); characterized in that said second spring (64, 74) is preloaded between said disk (27) and an annular shoulder (63, 70) of said stem (47).

3. A valve as claimed in claim 2, characterized in that said second spring a a multiple-leaf spring (64).

4. A valve as claimed in claim 3, characterized in that said multiple-leaf spring (64) comprises a number of coaxial Belleville washers (66); said shoulder (63) being defined between a first portion (61) of said stem (47) on which said armature (27) slides, and a second portion (62) of said stem (47) sliding inside a fixed bush (53).

5. A valve as claimed in claim 3, characterized in that said armature (27) comprises a number of sectors (38) separated by slots (39); and said multiple-leaf spring (64) is defined by a concave disk (68) having a number of elastic tabs (67) equal in number to said sectors (38) and each engaging a corresponding said sector (38).

6. A valve as claimed in claim 5, characterized in that means (71, 72) are provided between and for preventing mutual rotation of said concave disk (68) and said armature (27).

7. A valve as claimed in claim 6, characterized in that said means (71, 72) comprise at least one appendix (71) located on said concave disk (68) and engaging one of said slots (39).

8. A valve as claimed in claim 7, characterized in that said means (71, 72) comprise a cavity (72) located on at least one of said sectors (38) of said armature (27) and engaged by a corresponding tab (67) of said concave disk (68).

9. A valve as claimed in claim 2, characterized in that said second spring (74) is a truncated-cone-shaped or cylindrical helical compression spring.

10. A valve as claimed in claim 5, characterized in that said shoulder comprises a ring (70) housed inside a groove (65) on said stem (47); said concave disk (68) engaging said ring (70).

11. A valve as claimed in claim 10, characterized in that said first and second portions (61, 62) are of the same diameter.

12. A valve as claimed in claim 2, characterized in that said stem (47) comprises a flange (57) movable inside a swirl chamber (58) located between said control chamber (41) and a discharge chamber (37) in which to discharge fuel from said control chamber (41).

* * * * *